United States Patent [19]

Zemanek et al.

[11] 4,041,426

[45] Aug. 9, 1977

[54] MINIATURE ARMATURE RELAY

[75] Inventors: Zdenek S. Zemanék, Huntington Beach; Jack M. Brown, Costa Mesa, both of Calif.

[73] Assignee: Esterline Electronics Corporation, Costa Mesa, Calif.

[21] Appl. No.: 624,521

[22] Filed: Oct. 22, 1975

[51] Int. Cl.[2] ..... H01H 51/08

[52] U.S. Cl. ..... 335/131; 335/126

[58] Field of Search ..... 335/131, 126, 187, 202, 335/203, 106

[56] References Cited

U.S. PATENT DOCUMENTS

| | | | |
|---|---|---|---|
| 803,486 | 10/1905 | Hill | 335/126 |
| 1,689,075 | 10/1928 | Lehman | 335/126 |
| 3,141,939 | 7/1964 | Mink | 335/126 |
| 3,361,997 | 1/1968 | Freeman, Jr. | 335/133 |
| 3,418,608 | 12/1968 | Angel et al. | 335/131 |
| 3,501,719 | 3/1970 | Richert | 335/106 |
| 3,553,729 | 1/1971 | Mori et al. | 335/106 |
| 3,811,102 | 5/1974 | Ash | 335/106 |
| 3,828,286 | 8/1974 | Bain | 335/126 |

*Primary Examiner*—Harold Broome
*Attorney, Agent, or Firm*—Harvey C. Nienow

[57] ABSTRACT

A miniature armature relay having a substantially flat header and a cover therefor. Attached to the header is an electromagnetic operator which comprises an electromagnetic winding and a reciprocatable armature therewithin which carries a disc-shaped contactor.

Mounting lugs are fixed to the header on opposite sides of the armature, and individually carry a stationary contact to be engaged by the contactor. Alignment means comprising a pair of anchor lugs on opposite sides of the armature, and a flexible member secured to the armature and such anchor lugs is also included. A biasing spring urges the armature to retracted position and the electromagnetic operator overcomes such spring in response to energization of the winding thereof.

4 Claims, 5 Drawing Figures

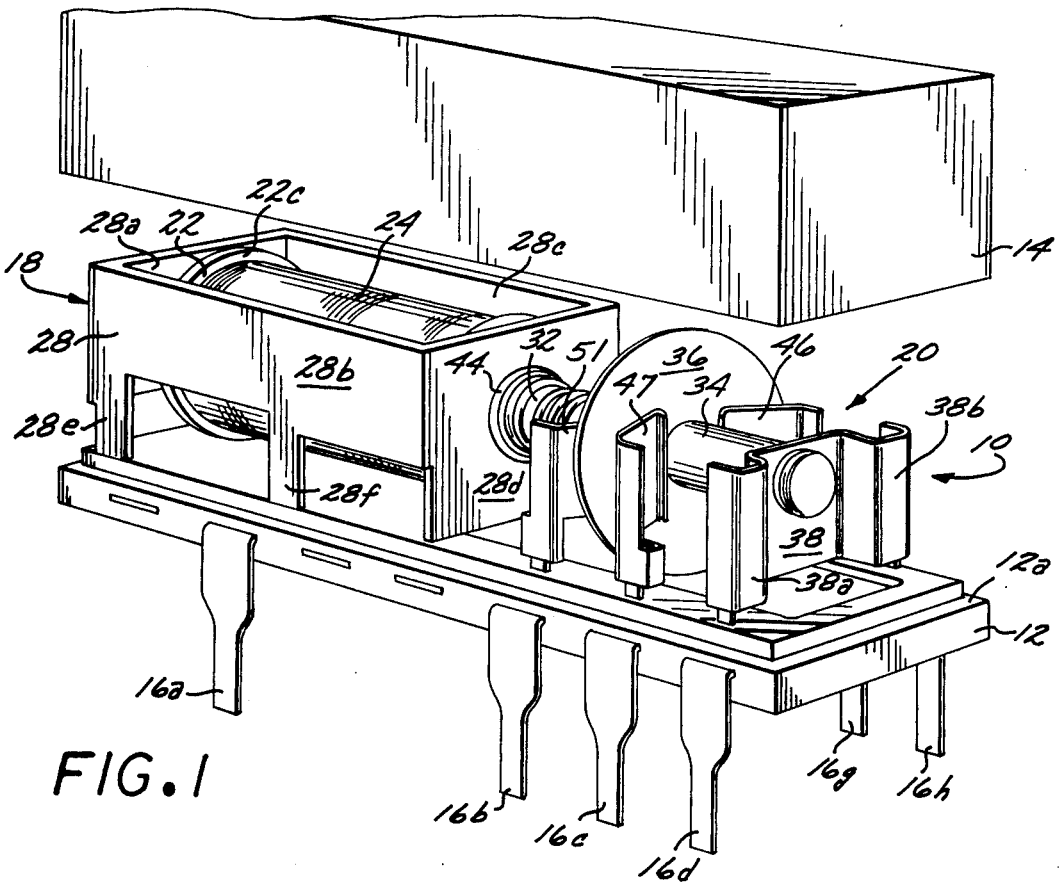
FIG. 1
FIG. 2
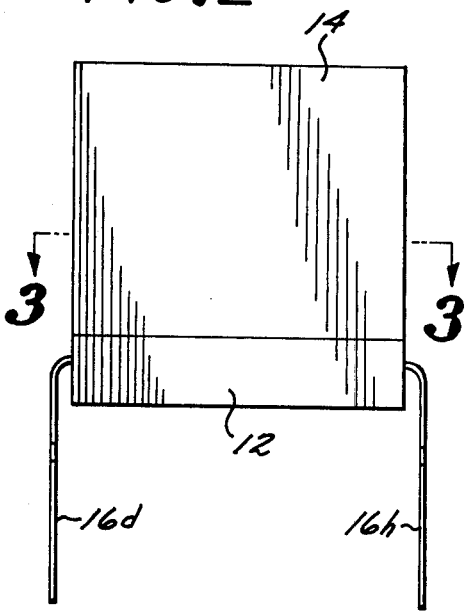
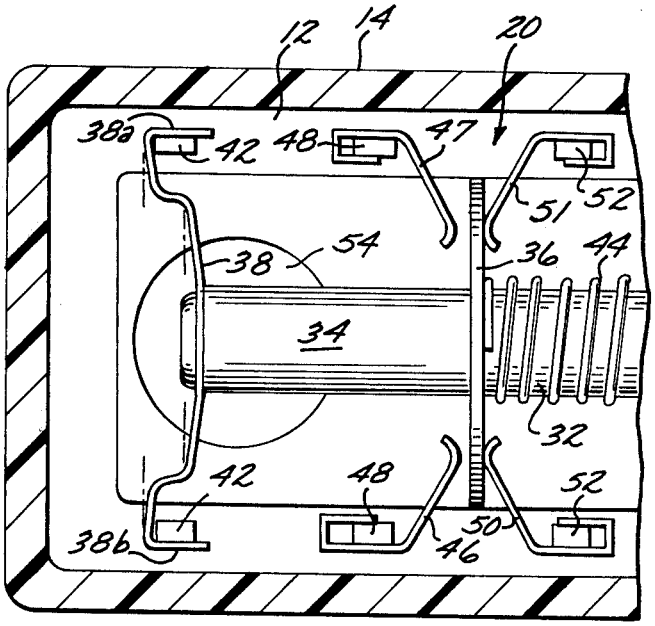
FIG. 5

MINIATURE ARMATURE RELAY

The present invention relates generally to miniature relays, and more particularly to armature relays wherein the armature is rectilinearly movable between two opposite positions.

Within the past decade or so, electronic devices have become increasingly dependent upon printed circuit boards to provide relatively large quantities at low cost. That is, in order to make most modern day electronic devices available to many individuals, it is necessary to utilize mass production procedures including printed circuit boards.

In view of this, many different types of relays have been miniaturized so as to be inexpensive and suitable for use on printed circuit boards. However, prior miniaturized relays have been unsuitable for certain types of applications. With this in mind, the subject armature relay has been devised to be compact for use on printed circuit boards and effective in operation in performing its function of controlling electrical circuits.

It is an object of the present invention to provide a miniature armature relay which is so constructed as to be usable on printed circuit boards.

Another object of the present invention is to provide a miniature armature relay as characterized above which comprises a rectilinearly movable armature within the coil or winding of an electromagnetic operator.

A further object of the present invention is to provide a miniature armature relay as characterized above which comprises an electromagnetic operator having an electromagnetic core within the coil or winding thereof and against which the electromagnetic armature is attracted upon energization.

An even further object of the present invention is to provide a miniature armature relay as characterized above which comprises at least one pair of mounting lugs on opposite sides of the armature and to each of which is attached a resilient stationary contact.

A still further object of the present invention is to provide a miniature armature relay as characterized above which comprises a disc-shaped contactor carried by the armature, a biasing spring being employed for moving the armature to one position when the electromagnetic force is removed.

Another further object of the present invention is to provide a miniature armature relay as characterized above which is simple and inexpensive to manufacture and which is rugged and dependable in operation.

The novel features which we consider characteristic of our invention are set forth with particularity in the appended claims. The invention itself, however, both as to its organization and mode of operation, together with additional objects and advantages thereof, will best be understood from the following description of specific embodiments when read in connection with the accompanying drawings, in which:

FIG. 1 is a perspective view of a miniature armature relay according to the present invention;

FIG. 2 is a front elevational view thereof;

FIG. 5 is a fragmentary sectional view of a portion of such miniature armature relay.

Like reference characters indicate corresponding parts throughout the several views of the drawings.

Referring to FIG. 1 of the drawings, there is shown therein a miniature armature relay 10 according to the present invention. It comprises an enclosure which includes a relatively flat header 12 and a cover 14.

The header 12 is formed of any appropriate insulating material and is generally rectangular in shape. It is formed with a peripheral ledge 12*a* against which the lower edge of cover 14 engages to be sealed in such position, if desired.

A plurality of mounting terminals 16*a*, 16*b*, 16*c* and 16*d* are molded in one side of the header 12, each of such terminals having a reduced lower end portion for insertion into appropriate openings in a printed circuit board. As shown most particularly in FIG. 4 of the drawings, the other side of header 12 is provided with terminals 16*e*, 16*f*, 16*g* and 16*h* molded therein. Each of the eight terminals is utilized for electrically connecting various of the components of the relay 10 to conductors and components on the printed circuit board (not shown).

Typically, the subject relay 10 may be mounted on a printed circuit board by insertion of the various terminals in the appropriate mounting openings, and thereafter, the entire board may be dip soldered so as to firmly and electrically secure such relay to the board.

Figure 3:
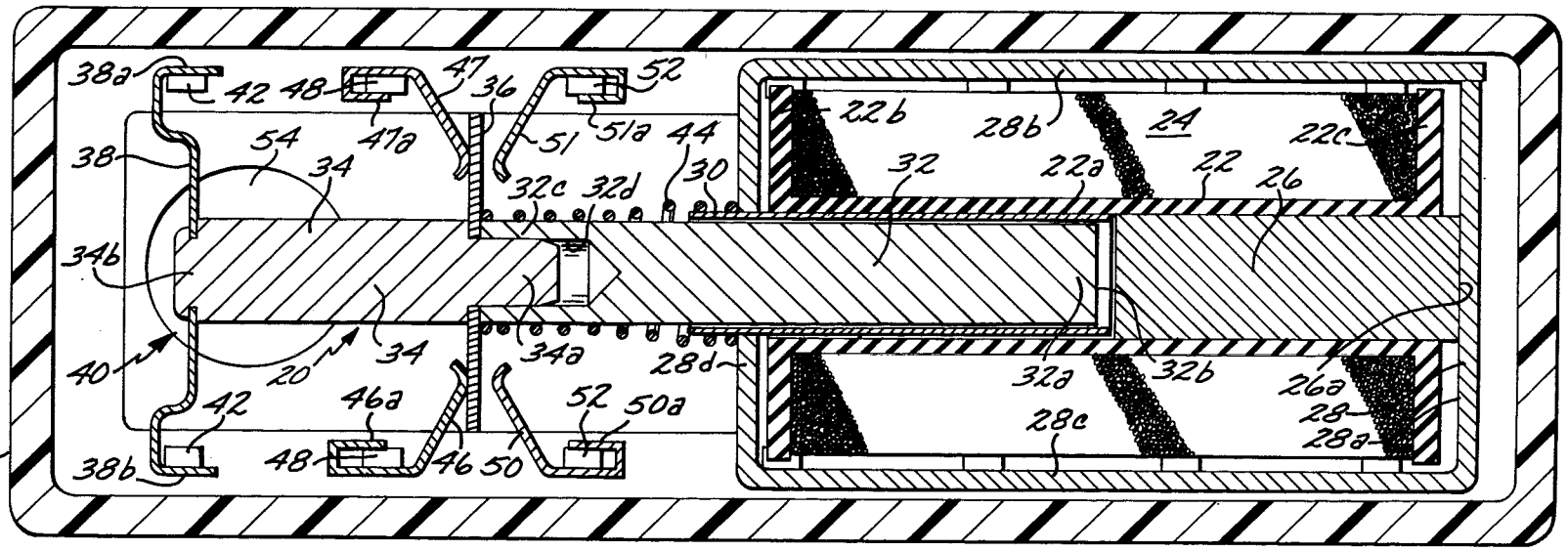
FIG. 3 is a longitudinal sectional view, taken substantially along line 3—3 of FIG. 2.

Mounted on the header 12 is an electromagnetic operator 18 which actuates a contact assembly 20 as will hereinafter appear. Referring to FIG. 3 of the drawings, the electromagnetic operator comprises a cylindrically shaped bobbin 22 which is formed of nylon or any other appropriate insulating material, and comprises a cylindrical intermediate portion 22*a* and disc-shaped opposite end portions 22*b* and 22*c*. Wound on bobbin 22 is an electromagnetic coil or winding 24 comprising a plurality of convolutions or turns of electrical wire.

An iron core 26 which is generally cylindrical in shape and has relatively flat opposite end surfaces is positioned within the central through opening of the bobbin. Such core is positioned within such through opening as shown most clearly in FIG. 3 of the drawings.

Magnetic path means is provided on the header 12 and comprises a box-like frame 28 made of iron or any other suitable magnetic material. Such frame 28 comprises an end member 28*a* which engages the relatively flat surface 26*a* of core 26, a pair of side members 28*b* and 28*c* and a forward member 28*d*.

Figure 4:
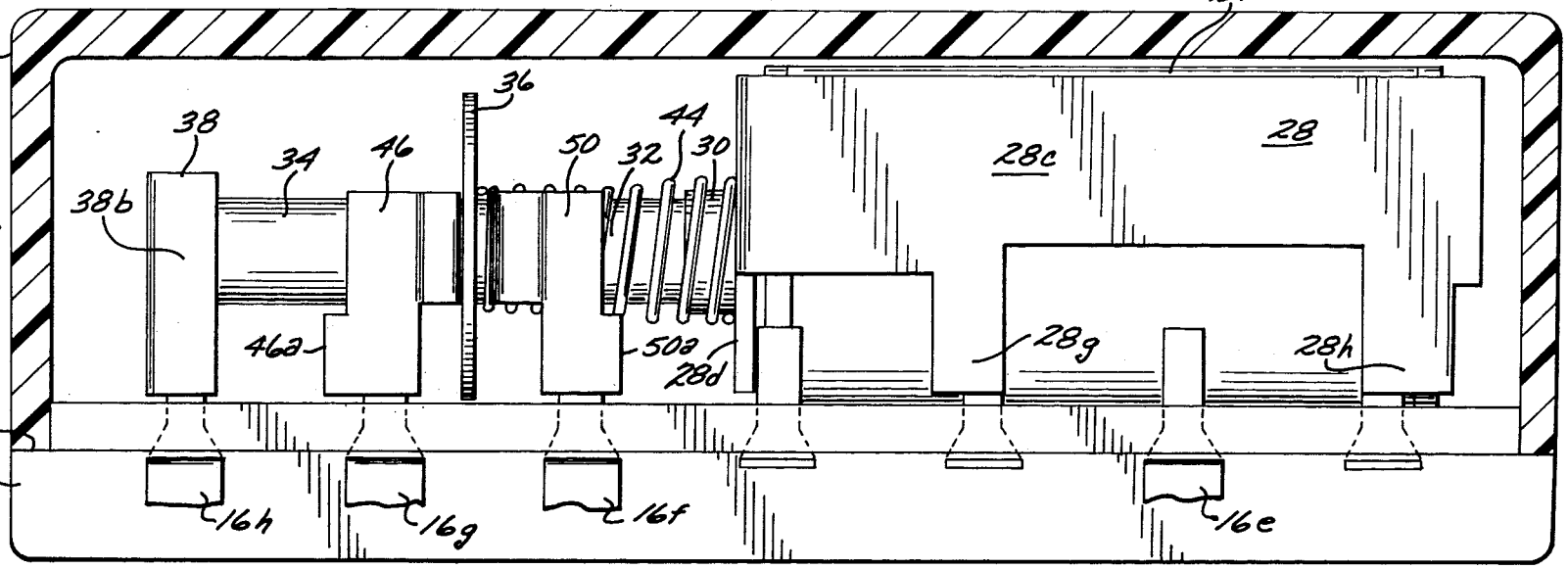
FIG. 4 is a fragmentary sectional view, showing the components of the relay in side elevation.

As shown most clearly in FIG. 1 and 4 of the drawings, the forward member 28*d* of frame 28 engages the header 12 and legs 28*e*, 28*f*, 28*g* and 28*h* are provided for further assisting in supporting the frame on the header.

The member 28*d* is formed with a through opening for receiving a sleeve 30 formed of non-magnetic material. Within such sleeve is a rectilinearly movable armature 32 which is generally cylindrical in construction and is formed of iron or any other appropriate magnetic material as will hereinafter become more apparent. To facilitate such movement of armature 32, sleeve 30 is formed with three equiangularly spaced internal bosses or protrusions which act as minimum friction guide means for the armature. One end 32*a* of armature 32 is formed with a flat surface 32*b*, and the opposite end 32*c* is formed with a longitudinal or axial opening or cutout 32*d*.

An electrically conductive member 34 is secured to the end 32*c* of armature 32, a reduced end portion 34*a* thereof being inserted into the opening 32*d*. Member 34 is preferably formed of brass or the like, and a disc-shaped contactor 36 is loosely secured between such member 34 and armature 32. Such contactor is formed of silver or the like and is in electrically conductive relation to conductor 34. As shown in FIG. 1, contactor 36 is formed with a generally circular outer edge or periphery.

One end 34*b* of conductor 34 carries a flexible member 38 which is an electrical conductor as well as being part of alignment means 40 for insuring axial alignment of armature 32 and conductor 34 during rectilinear movement thereof as will hereinafter appear. Also included in such alignment means is a pair of anchor lugs 42 secured to the header 12 on opposite sides of conductor 34. Such lugs 42 may be connected to terminals 16*d* and 16*h*, if it is desired to control an electrical circuit connected thereto in response to energization and de-energization of operator 18. To facilitate both the mechanical and electrical connections, the opposite ends 38*a* and 38*b* of flexible member 38 are reversely bent to grip the anchor lugs 42 as shown in the drawings.

Interposed between the disc-shaped contactor 36 and the member 28*d* of magnetic frame 28 is a compression spring 44 which operates to urge the armature 32 and its associated components away from the electromagnetic operator 18. To prevent spring 44 from interferring with armature 32 at member 28*d* of frame 28, the sleeve 30 is caused to be extended from member 28*d* to act as a collar. The force of spring 44 is overcome by the magnetic flux of operator 18, as will hereinafter appear, wherever winding 24 is energized.

For cooperation with contactor 36, there is provided, on opposite sides of the armature 32, various stationary electrical contacts. A first pair of stationary contacts 46 and 47 is provided on opposite sides of conductor 34, and may be termed normally closed contacts. Each such stationary contact 46 and 47 is formed of resilient electrically conductive material and is provided with a reversely bent end portion for engagement with a mounting lug 48 as shown at 46*a* and 47*a*, respectively. Each lug 48 is molded within the header 12 and is connected in circuit with the appropriate one of the terminals 16*c* and 16*g*.

A second pair of stationary contacts 50 and 51 is provided on opposite sides of armature 32. These contacts are normally open and, like the contacts 46, are formed of resilient electrically conductive material and have reversely bent end portions to engage mounting lugs 52 as shown at 50*a* and 51*a* respectively. These lugs are also molded in the header and are individually connected in circuit with terminals 16*b* and 16*f*.

Terminals 16*a* and 16*e* are connected to the opposite ends of winding 24 of electromagnetic operator 18.

Upon energization of winding 24 through terminals 16*a* and 16*e*, electromagnetic flux is caused to flow through the frame 28, core 26 and armature 32. Due to the air gap between the rear face 32*b* of armature 32 and core 26, armature 32 is drawn back toward the core against the force of compression spring 44. This causes the disc-shaped contactor 36 to be disengaged from the normally closed contacts 46 and to engage the normally open contacts 50. As a result, the circuit or circuits having contacts 46 and 47 are opened and the circuit or circuits having the contacts 50 and 51 are closed. Terminals 16*d* and 16*h* may be included in the circuits controlled by the action of contactor 36, or the respective pairs of stationary contacts 46–47 and 50–51 may be connected directly in the circuits to be controlled. That is, the particular contact assembly 20 enables various different circuit arrangements to be provided. Since contactor 36 is continually in circuit with terminals 16*d* and 16*h*, through conductor 34, flexible member 38 and lugs 42, the action of contactor 36 can be utilized to connect and disconnect such terminals from the circuits of stationary contacts 46–47 and 50–51. On the other hand, either of the pairs of stationary contacts 46–47 and 50–51 can be utilized to independently control an electrical circuit, if desired.

As shown most clearly in FIGS. 3 and 5 of the drawings, a filter 54 may be positioned in the header 12 to enable the enclosure to "breathe" while preventing the engress of moisture or other foreign material.

It is thus seen that the present invention provide a miniature armature relay which is particularly unique in being adapted for connection to printed circuit boards and for controlling various different types of electrical circuits.

Although we have shown and described certain specific embodiments of our invention, we are well aware that many modifications thereof are possible. The protection, therefore, is not to be restricted except insofar as is necessitated by the prior art and by the appended claims.

We claim:

1. A miniature armature relay comprising in combination, a generally flat coplanar header and a cover therefor, an electromagnetic operator fixed to said header comprising an electrically energizable winding and means affording a magnetic circuit including an armature, alignment means comprising a pair of anchor lugs fixed to said header on opposite sides of said armature and a flexible member fixed to said armature and to said anchor lugs to limit said armature to rectilinear movement, biasing means urging said armature in one direction, the electromagnetic operator being operable to overcome said biasing means to move said armature in the direction opposite to said one direction, at least one pair of electrically conductive mounting lugs in said header on opposite sides of said armature, a stationary contact fixed to each of said lugs, an electrically conductive contactor carried by said armature for reciprocatable movement into bridging engagement with said stationary contacts with corresponding movement of said armature, and a mounting terminal for each of said lugs connected in circuit therewith within said header and extending from the edge of said flat header, said terminals being formed with a right angle exteriorly of said header for insertion in appropriate openings in a printed circuit board.

2. A miniature armature relay according to claim 1, wherein said flexible member is formed with reversely bent opposite end portions connected to the respective anchor lugs.

3. A miniature armature relay according to claim 2, wherein at least two pairs of electrically conductive mounting lugs are provided each of which has a stationary contact fixed thereto, said contactor alternatively engaging the pairs of stationary contacts to effect alternative making and breaking of two different circuits.

4. A miniature armature relay according to claim 3, wherein said flexible member is formed of electrically conductive material and is connected in circuit with said contactor, and a mounting terminal is provided for each anchor lug and is connected thereto within said header, each anchor lug terminal extending from the edge of said header and being formed with a right angle exteriorly of said header for connection in an electrical circuit for control thereof with movement of said contactor in making and breaking the two different circuits of said pairs of stationary contacts.

* * * * *